US011149494B2

(12) United States Patent
Forseth

(10) Patent No.: US 11,149,494 B2
(45) Date of Patent: Oct. 19, 2021

(54) LADDER SAFETY LOCK SYSTEM

(71) Applicant: Chris F. Forseth, Kalispell, MT (US)

(72) Inventor: Chris F. Forseth, Kalispell, MT (US)

(73) Assignee: TORRGRAM LLC, Kalispell, MT (US)

( * ) Notice: Subject to any disclaimer, the term of this patent is extended or adjusted under 35 U.S.C. 154(b) by 315 days.

(21) Appl. No.: 16/155,743

(22) Filed: Oct. 9, 2018

(65) Prior Publication Data

US 2020/0109601 A1 Apr. 9, 2020

(51) Int. Cl.
*E06C 1/06* (2006.01)
*E06C 7/50* (2006.01)
*E06C 7/12* (2006.01)

(52) U.S. Cl.
CPC ..... *E06C 7/505* (2013.01); *E06C 1/06* (2013.01); *E06C 7/12* (2013.01)

(58) Field of Classification Search
CPC ..... E06C 7/12; E06C 7/505
See application file for complete search history.

(56) References Cited

U.S. PATENT DOCUMENTS 416,226 A 12/1889 Kidder
1,386,511 A * 8/1921 Krahlemilc ..... E06C 7/12 182/129
3,792,756 A 2/1974 Kelly
4,061,203 A 12/1977 Spencer et al.
4,363,378 A 12/1982 Williams et al.
4,458,783 A 7/1984 Stakes
4,519,477 A 5/1985 Ralston
4,545,460 A 10/1985 Byrd
4,787,478 A 11/1988 Stakes, Jr.
5,165,501 A 11/1992 Donahey
5,279,389 A * 1/1994 Crockett ..... E06C 7/48 182/129
5,638,916 A 6/1997 Schneider
5,931,259 A 8/1999 Hoey
6,019,191 A * 2/2000 Flores ..... E06C 7/48 182/107
6,244,381 B1 * 6/2001 Ruble ..... B66B 9/187 182/103
6,250,424 B1 6/2001 Luag
6,354,400 B1 3/2002 Purkayastha
6,394,229 B1 5/2002 Hastreiter
6,427,803 B1 8/2002 Moore
6,691,825 B2 2/2004 Haig
6,698,546 B1 3/2004 Sandor, Sr.
6,729,441 B1 5/2004 Nahlen
7,195,099 B2 * 3/2007 Harney ..... E04G 3/26 182/45
7,318,579 B1 * 1/2008 Novoa ..... E06C 7/12 254/278
7,377,360 B1 5/2008 Misiak et al.
(Continued)

FOREIGN PATENT DOCUMENTS

EP 1911926 A1 4/2008
WO 2002006623 A1 1/2002

*Primary Examiner* — Alvin C Chin-Shue
(74) *Attorney, Agent, or Firm* — Holzer Patel Drennan

(57) ABSTRACT

A ladder safety lock disclosed herein includes a rod adapted for insertion through a ladder rung and at least one hinged flap attached an end of the rod that is configured for attachment to a free-standing secure structure, such as a portion of a roof or wall.

19 Claims, 7 Drawing Sheets

(56) References Cited

U.S. PATENT DOCUMENTS

| | | | | |
|---|---|---|---|---|
| 7,445,086 | B1 | 11/2008 | Sizemore | |
| 7,575,097 | B2 | 8/2009 | Sheridan et al. | |
| 8,464,834 | B2 | 6/2013 | Blazin et al. | |
| 8,887,867 | B2 | 11/2014 | Blazin et al. | |
| 2002/0108811 | A1 | 8/2002 | Ulmschneider et al. | |
| 2005/0139425 | A1 | 6/2005 | Thomas et al. | |
| 2006/0054391 | A1 | 3/2006 | Tilley | |
| 2007/0278040 | A1 | 12/2007 | Rager | |
| 2009/0107765 | A1 | 4/2009 | Germond | |
| 2011/0067954 | A1 | 3/2011 | Deal | |
| 2014/0083799 | A1 | 3/2014 | Evans | |
| 2015/0226002 | A1* | 8/2015 | Johansen | E06C 7/12<br>182/217 |
| 2015/0337596 | A1 | 11/2015 | Cherevko et al. | |
| 2016/0281427 | A1 | 9/2016 | Weatherall | |

* cited by examiner

LADDER SAFETY LOCK SYSTEM

BACKGROUND

Working on ladders can be dangerous, particularly for homeowners attempting do-it-yourself projects who are unaccustomed to heights and/or precautions that are commonly taken by contracting professionals that regularly work in such environments. Unbalanced movements such as overreaching when painting walls or mounting and dismounting a ladder on a roof can cause the ladder to topple sideways or slide backward and cause serious injury. Although there exist some tools designed to increase ladder safety, such tools are typically complex, expensive, difficult to use, and unable to truly secure a ladder safely.

BRIEF DESCRIPTIONS OF THE DRAWINGS

SUMMARY

A ladder safety lock disclosed herein includes a rod and a hinged flap attached to an end of the rod. The rod is adapted for insertion through a ladder rung and the hinged flag is configured for attachment to an anchor point on a free-standing structure. In some implementations, the ladder safety lock is adapted for attachment to a product lift including a pulley for raising a load from ground level to a heightened position proximal to the ladder rung.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

DETAILED DESCRIPTION

Figure 1:
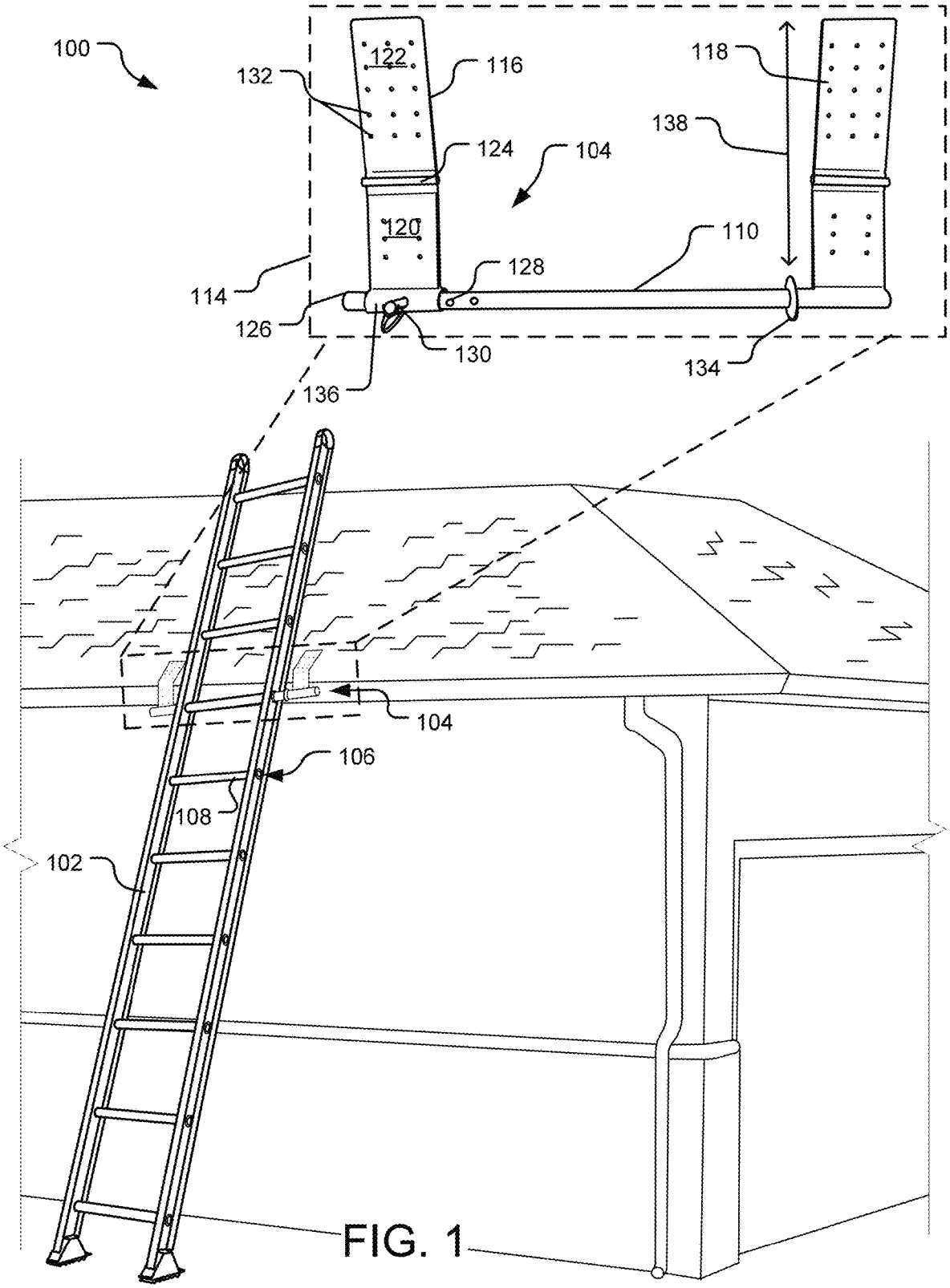
FIG. 1 illustrates a scene including a ladder secured to a roof by an example ladder safety lock.

FIG. 1 illustrates a scene 100 including a ladder 102 secured to a roof by an example ladder safety lock 104. The ladder 102 includes hollow rungs (e.g., a rung 108) that each have a central cavity 106 extending longitudinally through the rung and opening to an external environment on opposite ends, as common with many ladders on the market today. The ladder safety lock 104 is designed to be inserted through and lock within a select one of the ladder rungs while simultaneously anchoring the ladder 102 to a stationary anchor point, such as a roof mounting block or part of a roof, wall, or other structure.

As shown in greater detail in a magnified view 114, the ladder safety lock 104 includes an elongated rod 110 sized and shaped for insertion into the central cavity 106 of a select one of the ladder rungs. The elongated rod 110 is shown to be cylindrical but may, in other implementations, assume any size or shape suitable for insertion within a ladder rung. In addition to the elongated rod 110, the ladder safety lock 104 is shown to include two hinged flaps 116, 118 each positioned proximal to a corresponding end of the elongated rod 110 such that the hinged flaps 116, 118 each rest external to and on opposite ends of a ladder rung when the ladder safety lock 104 is used to secure the ladder 102 against a structure, as shown. Although other configurations are contemplated, the ladder safety lock 104 of FIG. 1 includes a flanged protrusion 134 (e.g., a washer secured into place along the rod 110) positioned proximal to the hinged flap 118 to act as a stop point that prevents lateral movement of the elongated rod 110 within the ladder rung.

Each one of the hinged flaps 116, 118 includes first and second portions (e.g., a first portion 120 and a second portion 122) separated by a hinge (e.g., a hinge 124) that allows the first and second portions to fold relative to one another about a folding axis generally parallel to the elongated rod 110 and perpendicular to a long axis 138 of the hinged flaps 116 and 118.

In FIG. 1, the hinged flap 116 is removably attached to the elongated rod 110 while the hinged flap 118 is non-removably attached to the elongated rod 110. Although the removable hinged flap(s) may, in different implementations, be selectively secured to the elongated rod 110 in different ways, the hinged flap 116 is shown to include a base having a hollow cylindrical shaft 136 sized and shaped to receive and secure against a free end 126 the elongated rod 110.

In FIG. 1, the free end 126 of the elongated rod 110 is shown inserted through a cylindrical cavity in an end of the hinged flap 116 with a safety pin 130 (e.g., dowel) secured within aligned through-holes of the hinged flap 116 and a free end 126 of the elongated rod 110, effectively locking the hinged flap 116 into place relative to elongated rod 110. To secure the ladder safety lock 104 within a select rung of the ladder 102, a user may remove the safety pin 130 (e.g., a dowel) from aligned through-holes of the hinged flap 116 and the elongated rod 110; decouple the hinged flap 116 from the elongated rod 110; insert the free end 126 of the elongated rod 110 into a first end of the select ladder rung, and slide the elongated rod 110 through the select ladder rung until the free end 126 protrudes from the opposite side of the select ladder rung. In one implementation, the elongated rod 110 rests within the select ladder rung such that the flanged protrusion 134 rests with one surface flush with or proximal to the side of the ladder 102.

While the elongated rod 110 is positioned through the select ladder rung in the above-described manner, a user can secure the rod 110 within the select ladder rung by sliding the hinged flap 116 over the free end 126 of the elongated rod 110 and re-inserting the safety pin 130 through the aligned through-holes of the hinged flap 116 and the elongated rod 110.

In FIG. 1, each of the hinged flaps 116, 118 includes a plurality of small holes (e.g., holes 132) to receive attachment hardware (e.g., one or more nails or screws) for attaching each of the hinged flaps 116, 118 to a secure anchor point on a free-standing structure, such as a wall, roof, tree, etc. In some implementations, the ladder safety lock 104 may be attached directly to a portion of a house or roof. If, for example, the house or roof is unfinished, the user may choose to attach the ladder safety lock 142 to exposed wood framing or plywood. In cases when the user is working on a finished structure, the user may choose to attach mounting block (e.g., a commercially purchased or homemade structure) to the roof and then attach the ladder safety lock 104 to the mounting block (thereby avoiding a direct coupling between the roof and the ladder safety lock 104). In other scenarios, the ladder safety lock 104 may be securely coupled to other anchor points on free-standing structures.

In one example implementation of use, the second portion 122 of each of the flaps 116, 118 is positioned to have a surface flush against an anchoring point on a roof or other structure, and one or more screws or nails is then inserted through the corresponding holes 132 in the flap to lock each of the flaps 116, 118 into place against the anchoring point. In this manner, both of the hinged flaps 116, 118 are securely fastened to the structure, locking the ladder 102 into position while a user scales the ladder.

To removably couple the ladder safety lock 104 from the ladder and roof, the user removes the screws or nails from the portions 122 of the flaps 116, 118 to decouple the flaps 116, 118 from the anchoring point. The user may then remove the safety pin 130, slide the hinged flap 116 off the rod 110, and remove the rod 110 from the select ladder rung.

Figure 2:
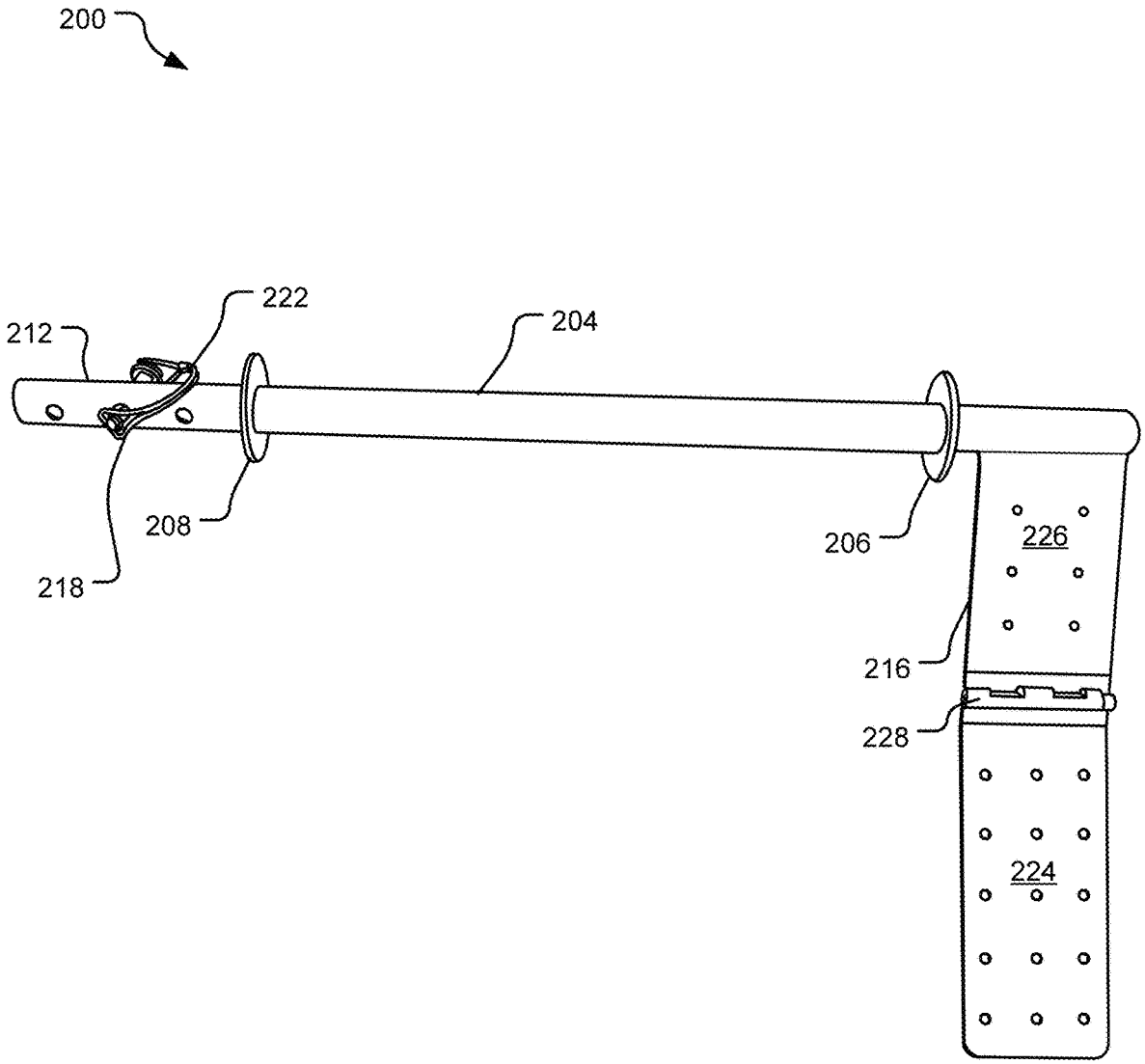
FIG. 2 illustrates another example ladder safety lock.

FIG. 2 illustrates another example ladder safety lock 200. In contrast to the ladder safety lock of FIG. 1 with two hinged flaps, the ladder safety lock 200 includes a single hinged flap 216 positioned proximal to a first end of an elongated rod 204. The elongated rod 204 includes flanged portions (e.g., washers 206, 208) designed to rest adjacent to exterior-facing surfaces of a ladder proximal to opposing ends of a select ladder rung. In one implementation, the washer 208 is removably attached to the rod 110. Prior to inserting the elongated rod 204 through a ladder rung, a user selectably slides the washer 208 off the free end 212 of the elongated rod 204. The user may then slide the washer 208 back over the free end 212 after the elongated rod 204 is positioned within the ladder rung with the free end 212 protruding from a first side of the rung and the hinged flap 216 resting adjacent to an opposite side of the rung.

The ladder safety lock 200 includes a locking mechanism 218 which serves to prevent the free end 212 from sliding out of the ladder rung when the ladder safety lock 200 is in use. Although the locking mechanism 218 may assume a variety of forms in different implementations, the locking mechanism 218 is shown to include a safety pin that can be inserted through a through-hole in the elongated rod 204. In FIG. 2, the locking mechanism 218 also includes a locking wire assembly 222 with opposing ends that clamp over opposite ends of the safety pin to secure the safety pin in place within the through-hole. In another implementation with a safety pin similar to that shown, a chain or cable extends between the safety pin and the adjacent washer (e.g., the washer 208) to couple washer and the safety pin together.

of FIG. 2, the hinged flap 216 has an elongated rectangular shaped including a first portion 224 and a second portion 226 separated by a hinge 228 that allows the first and second portions to fold relative to one another about an axis generally parallel to the elongated rod 204. The hinged flap 216 may be securely attached to a secure structure (e.g., a roof, wall, tree) in a manner the same or similar to that described above with respect to FIG. 1.

FIG. 1. In different implementations, the ladder safety lock 104 may have a variety of different characteristics, sized and shaped for use in different types of ladders. In one exemplary implementation, the rod 110 is a pipe approximately twenty-six inches long (or of other size long enough to extend through a ladder rung 22-inches long) with a three-quarter inch diameter (or other suitable size to extend through the cavity of the ladder rung).

Figure 3:
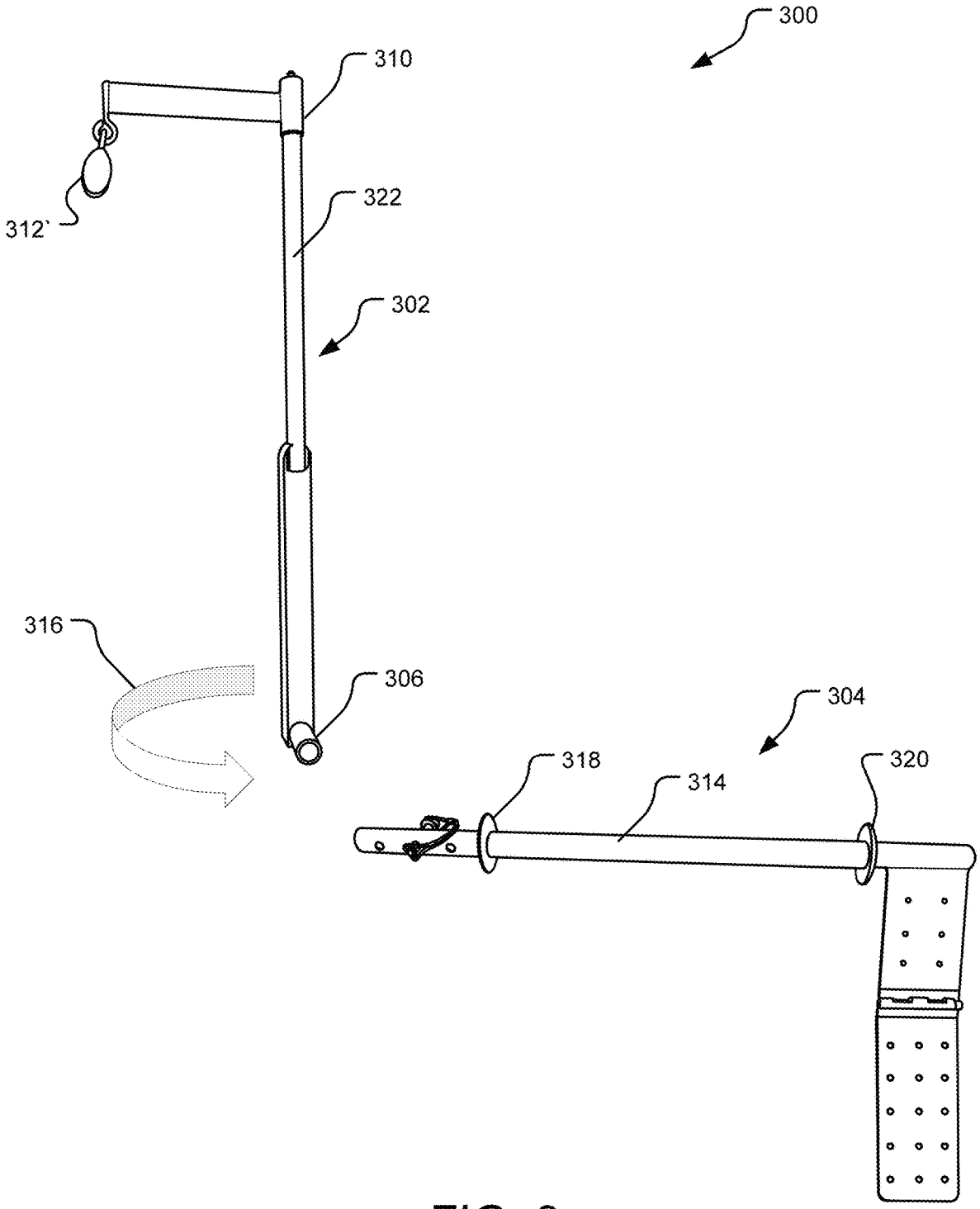
FIG. 3 illustrates components of an unassembled ladder lock-and-lift system.

FIG. 3 illustrates components of an unassembled ladder lock-and-lift system 300. The system 300 includes a ladder safety lock 304 that removably secures to a product lift 302. When the system 300 is assembled (e.g., as described further with respect to implementations shown in FIG. 4-7), the product lift 302 can be used to raise an item (e.g., a bucket, tools, or other work equipment) to a selectable, heightened position that the user can easily reach when working on the ladder.

In FIG. 3, the illustrated features of the ladder safety lock 304 are the same or similar to those described with respect to FIG. 1. The product lift 302 has a base end 306 that couples to the ladder safety lock 304. A load-bearing torque arm 322 extends between the base end 306 and an L-shaped end 310, which includes a pulley 312 usable to securely raise a load upward to an elevated position.

When the product lift 302 is secured relative to the ladder safety lock 304 and ladder as described with respect to FIGS. 4 and 5, below, the product lift 302 is fixedly positioned with an L-shaped end 310 and the pulley 312 raised relative to the base end 306. A rope or cable can be wrapped about the pulley 312 and used to securely raise a load upward. For example, a bucket of paint, tool bag, or other object(s) can be raised to an elevated position that is easily reached by a worker standing on the roof.

In one implementation, the L-shaped end 310 can be rotated relative to the load-bearing torque arm 322. For example, a user may manually move the L-shaped end 310 to a desired angle of rotation relative to the load-bearing torque arm 322 so as to selectably increase clearance between a raised product (e.g., a bucket) and the roof and/or to provide earlier access to the product from the roof.

In different implementations, the base end of the product lift 302 may couple to the ladder safety lock 304 in different ways. In the illustrated implementation, the base end 306 includes a cylindrical hollow shaft that is sized and shaped to slide over a rod 314 of the ladder safety lock 304. In one implementation, a user removes a washer 318 from the rod 314, rotates the product lift 302 to align an axis of the hollow cylindrical shaft in the base end 306 with the rod 314 (e.g., in a direction such as that shown by an arrow 316) and inserts the rod 314 through the cylindrical hollow shaft. Once the base end 306 of the product lift 302 is coupled to the rod 314 in this manner, a user may laterally slide the product lift 302 along the rod 314 to a position proximal to one of the ends of the rod 314. For example, a user may slide the cylindrical shaft along the rod 314 until the end of the shaft rests adjacent to an inner edge of one of the washers 318, 320. The coupled components are then inserted into a ladder rung, as generally described with respect to FIG. 4, below.

Figure 4:
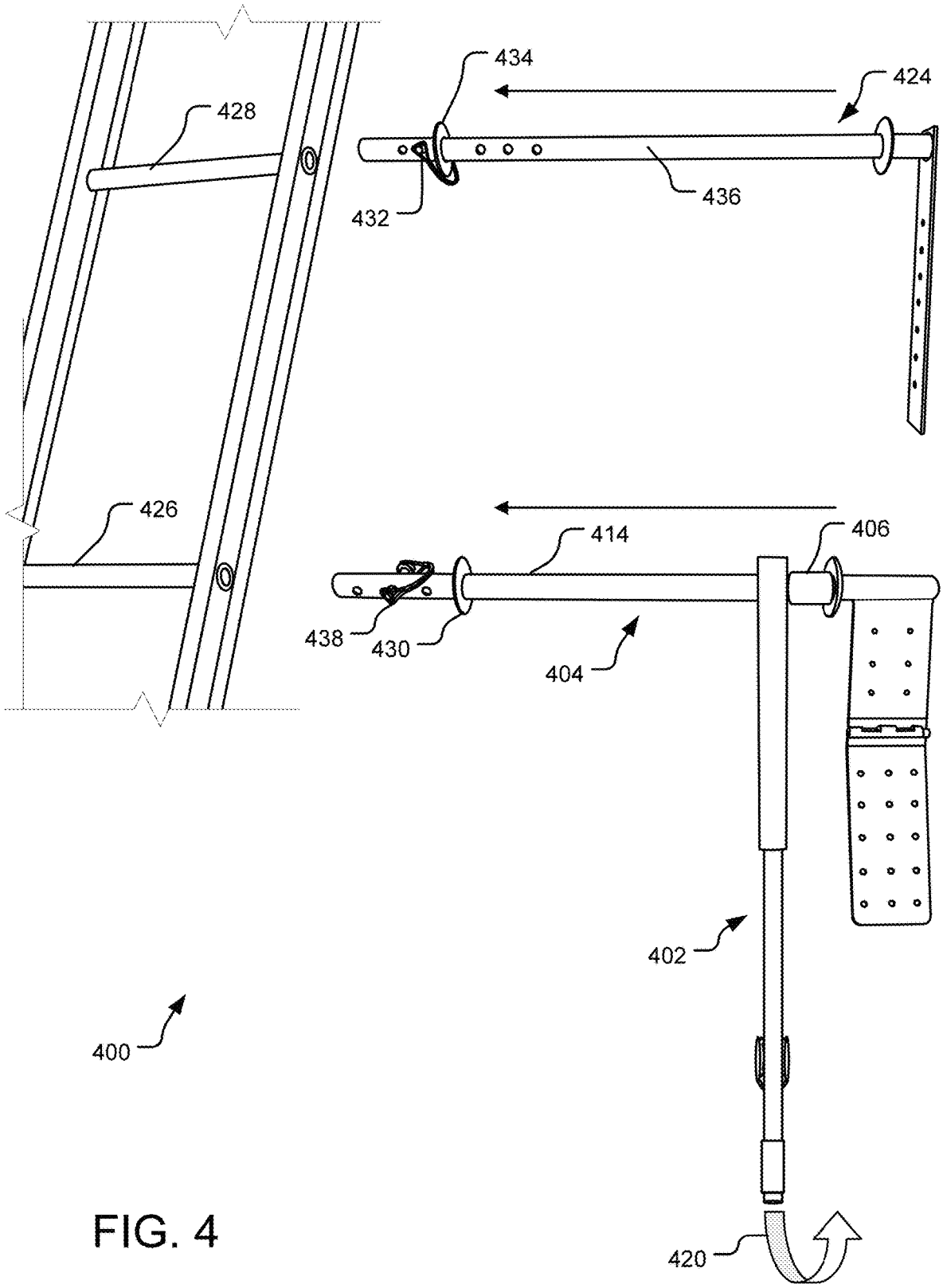
FIG. 4 illustrates components of another example ladder lock-and-lift system.

FIG. 4 illustrates aspects of another example lock-and-lift system 400 with a ladder safety lock 404 and a product lift 402, which may be the same or similar to those shown and discussed with respect to FIG. 3. The product lift 402 is shown coupled to the ladder safety lock 404 in the manner generally described above with respect to FIG. 3, with a rod 414 of the ladder safety lock 404 being inserted through a cylindrical cavity in the base end 406 of the product lift 402.

In one implementation, the coupling between the product lift 402 and the ladder safety lock 404 is loose enough to permit rotation of the product lift 402 about the rod 414, such as according to a rotational direction indicated by an arrow 420.

In addition to the product lift 402 and the ladder safety lock 404, FIG. 4 additionally illustrates an L-shaped lift support piece 424. In operation, the ladder safety lock 404 is secured with a portion of the rod 414 positioned internal to a first ladder rung 426 while the L-shaped lift support piece 424 is secured with a portion of a rod 436 positioned internal to a second ladder rung 428. Although the first ladder rung 426 is shown directly adjacent to the second ladder rung 428, the first and second ladder rungs may, in some implementations, be separated by one or more intervening rungs.

Although other locking mechanisms are contemplated, the ladder safety lock 404 and the L-shaped lift support piece 424 are each shown to include a washer (e.g., washers 430 and 434) and a locking mechanism (locking mechanisms 432 and 438), shown to be round head wire lock pins, for securing a corresponding rod (e.g., one of the rods 414 or 436) within the associated ladder rung. For example, a user may remove the locking mechanism 438 and washer 430 prior to inserting the rod 414 of the ladder safety lock 404 through the first ladder rung 426. After inserting the rod 414 into the first ladder rung 426, the user may re-affix the washer 430 and the locking mechanism 438 at a position external to the first ladder rung 426, thereby locking the rod 414 within the first ladder rung 426 (e.g., as shown in FIG. 5). The L-shaped lift support piece 424 may be similarly secured within the second rung 428 by removing the washer 434 and locking mechanism 432, inserting the rod 436 through the second ladder rung 428, and reattaching the locking mechanism 432 (e.g., as shown in FIG. 5). In this arrangement, the washers 430 and 434 each serve as a stop point preventing the corresponding rod 414 or 436 from sliding laterally relative to the ladder.

Figure 5:
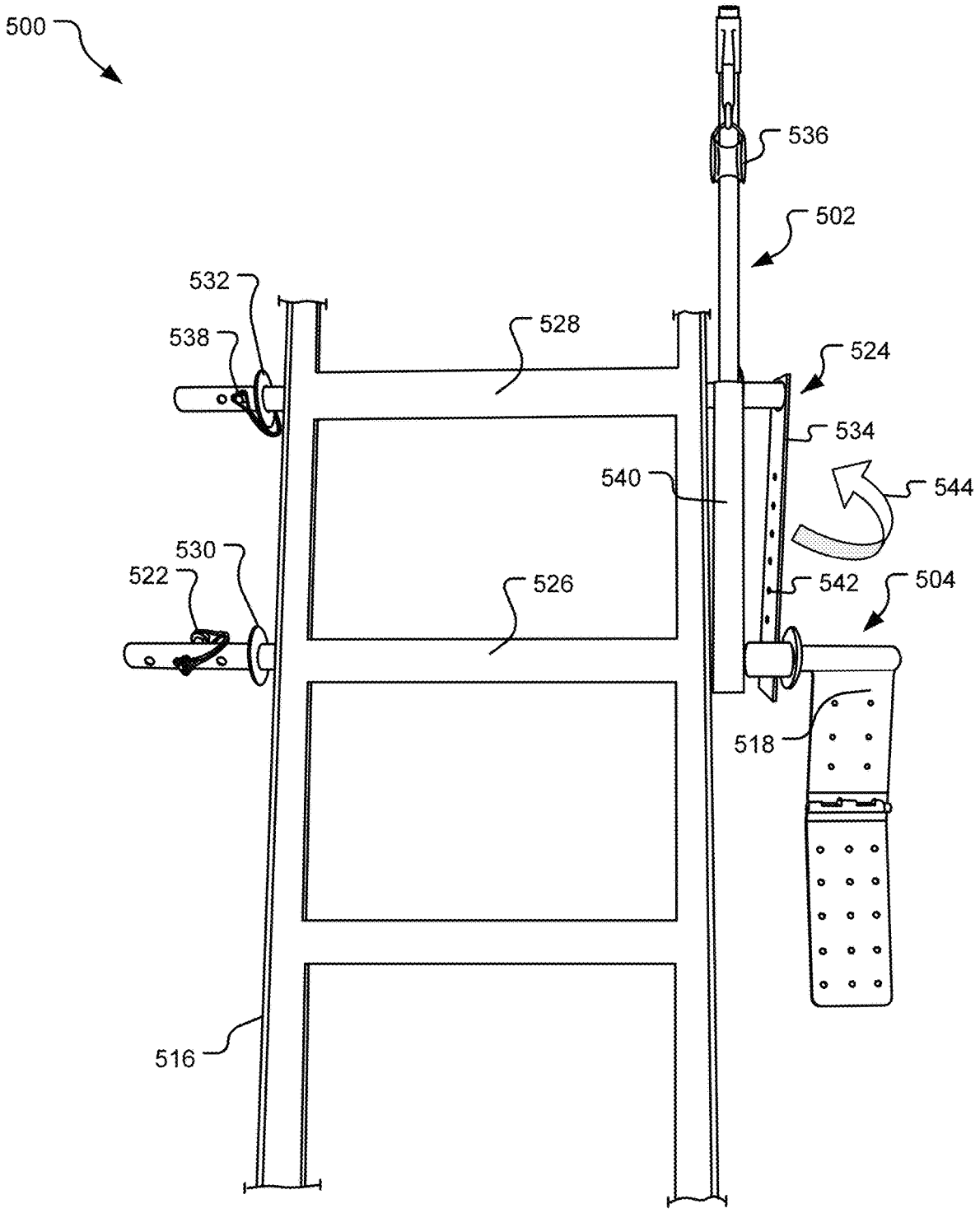
FIG. 5 illustrates a partially-assembled example lock-and-lift system with a ladder safety lock, product lift, and an L-shaped lift support piece.

FIG. 5 illustrates an example lock-and-lift system 500 at a later stage of assembly as compared to FIG. 4. The system 500 includes a ladder safety lock 504, product lift 502, and an L-shaped lift support piece 524. The ladder safety lock 504 and the product lift 502 are coupled to one another in a manner consistent with that shown and described in FIG. 4. The product lift 502 is shown rotated upward (e.g., in the direction indicated by arrow 420 in FIG. 4) with a pulley 536 raised to a heightened position above the ladder safety lock 504. The ladder safety lock 504 and the L-shaped lift support piece 524 are each secured to a ladder 516, such as in the manner described above with respect to FIG. 3-4.

The ladder safety lock 504 has an elongated central portion inserted through a first ladder rung 526. A first end of the ladder safety lock 504 includes a locking mechanism 522 and flanged stop point 530 (e.g., a washer), while a second opposite end of the ladder safety lock 504 is coupled to a product lift 502 with a distal end including a hinged flap 518 that may be anchored to a roof or other structure. The L-shaped lift support piece 524 has a central portion inserted through a second ladder rung 528. A first end of the L-shaped lift support piece 524 includes a locking mechanism 538 and flanged stop point 532 (e.g., another washer), while a second opposite end of the L-shaped lift support piece 524 includes a support extension 534 that extends perpendicular to the ladder rung 528.

After the product lift 502 is rotated relative to the ladder safety lock 504 to elevate the pulley 536 as shown, the product lift 502 can be secured in the elevated position by rotating the L-shaped lift support piece (such as in a direction generally indicated by an arrow 544) and attaching the support extension 534 of the L-shaped lift support piece 524 to a primary support beam 540 of the product lift 502. Such attachment may be achieved using a variety of suitable hardware couplings. In one implementation, one or more bolts are inserted through holes (e.g., a hole 542) of the support extension 534 and corresponding holes in the primary support beam 540. After inserting the bolt(s) through the support extension 534 and the primary support beam 540, a nut may be threaded onto a free end of each of the bolts to complete the connection and securely affix the support extension 534 to the primary support beam 540 of the product lift 502.

Figure 6:
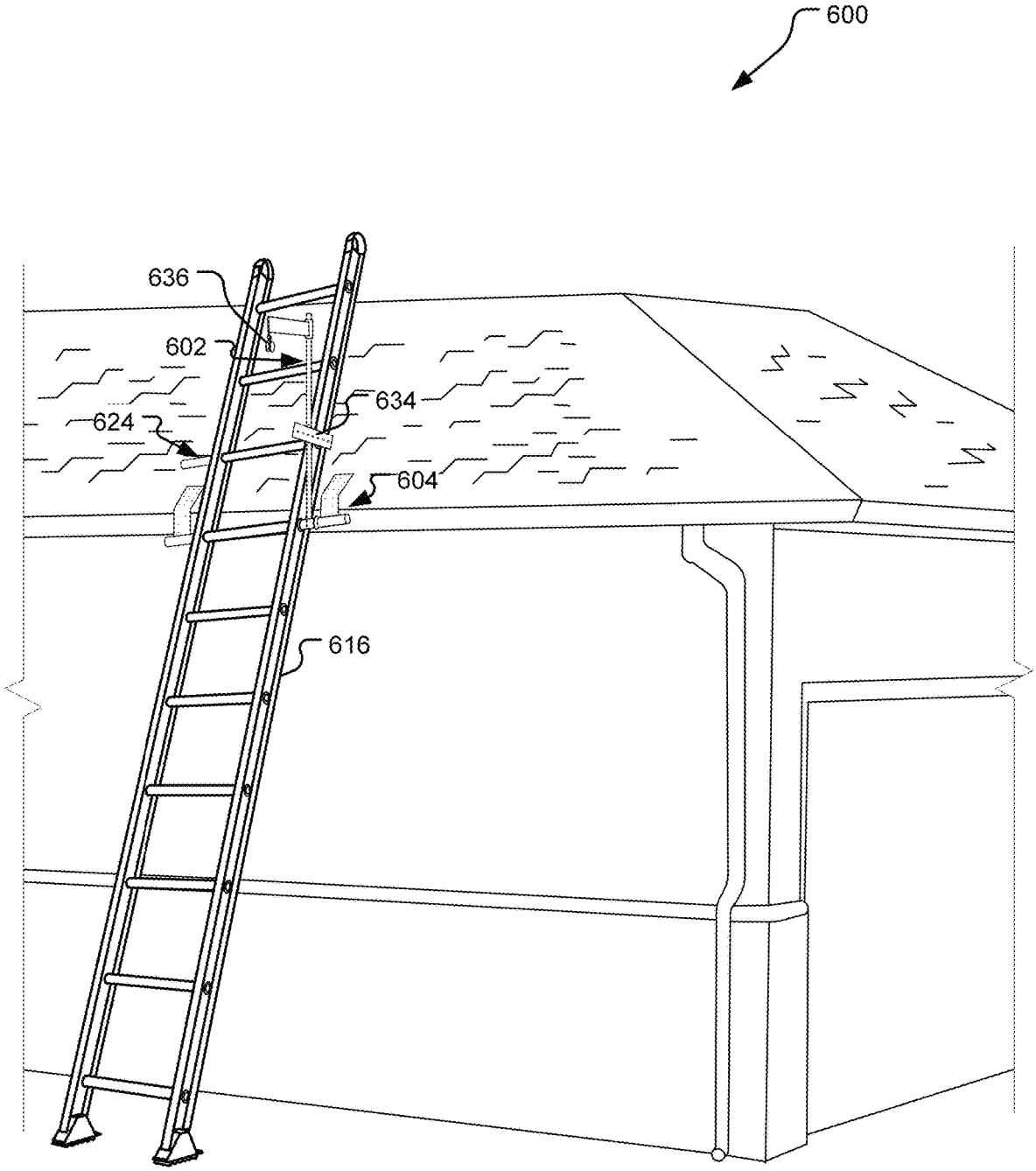
FIG. 6 illustrates another partially-assembled example lock-and-lift system with a ladder safety lock, product lift, and an L-shaped lift support piece.

FIG. 6 illustrates another example lock-and-lift system 600 with a ladder safety lock 604, product lift 602, and an L-shaped lift support piece 624 during a later stage of assembly as compared to the systems of FIGS. 4 and 5. Although the ladder safety locks 404 and 304 of FIGS. 3 and 4 include a single hinged flap, the ladder safety lock of FIG. 5 is shown to include two hinged flaps, similar to the implementation discussed with respect to FIG. 1. Other aspects of the ladder safety lock 404 may be identical to those described with respect to any of FIGS. 2-5.

In FIG. 6, the ladder safety lock 604 and the product lift 602 are coupled to one another in a manner consistent with that shown and described in FIG. 4. The ladder safety lock 604 and the L-shaped lift support piece 624 are each secured to adjacent rungs of a ladder 616 (such as in the manner also described above with respect to FIG. 3-4), and the ladder safety lock 604 is fixedly anchored to a roof (e.g., in a manner the same or similar to that described with respect to FIGS. 1-2). The product lift 602 is rotated upward to position a pulley 636 in an elevated position relative to the ladder safety lock 604, as shown. While the product lift 602 is held temporarily in this elevated position by a user, the user couples a support extension 634 of the L-shaped lift support piece 624 to a primary support beam 640 of the product lift 602, thereby securely affixing the product lift 602 into the illustrated elevated position.

Figure 7:
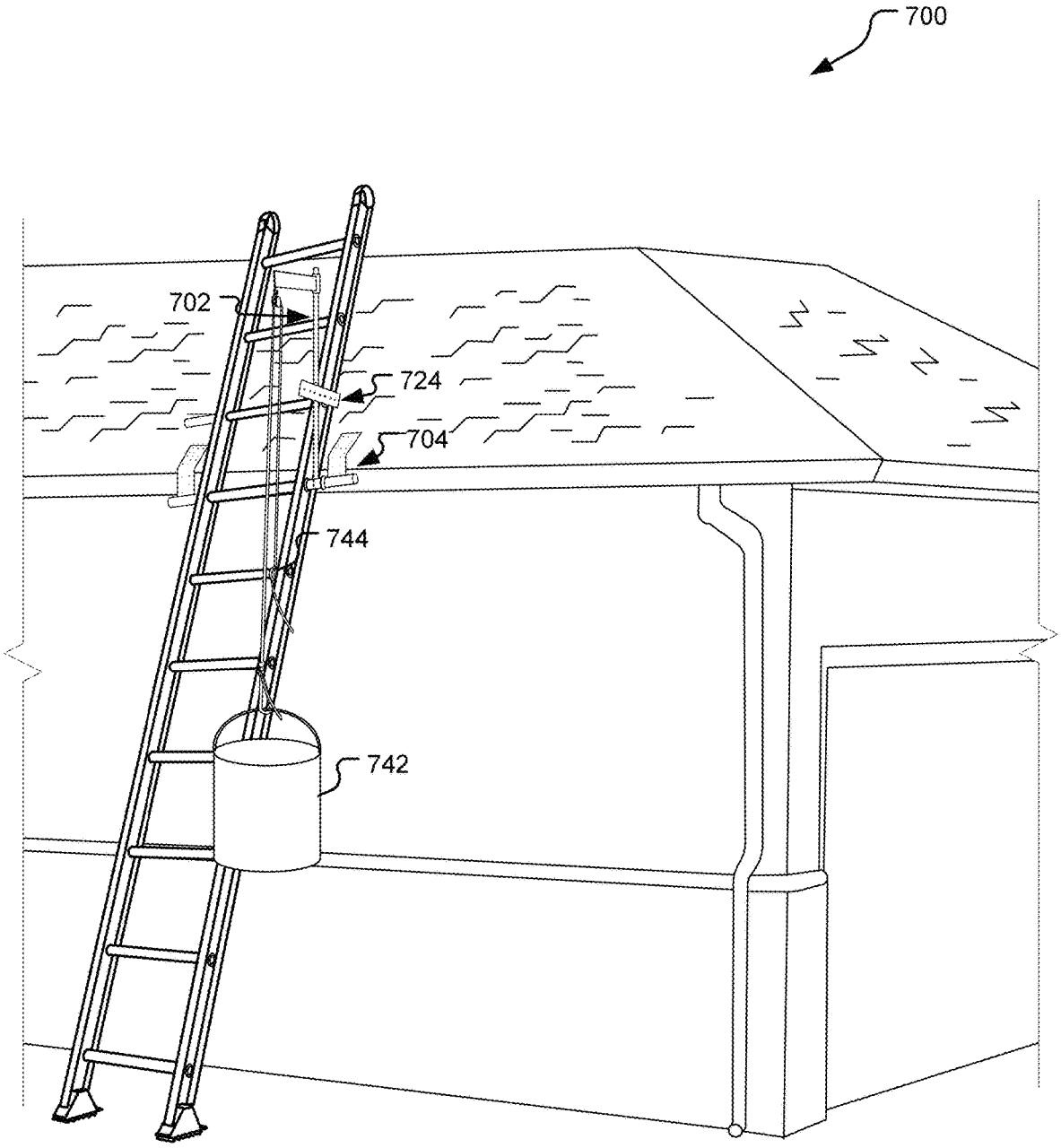
FIG. 7 illustrates a fully assembled lock-and-lift system with a ladder safety lock, product lift, and an L-shaped lift support piece.

FIG. 7 illustrates a fully assembled lock-and-lift system 700 with a ladder safety lock 704, product lift 702, and an L-shaped lift support piece 724. After securely affixing the product lift 702 in the elevated position shown (e.g., as generally described with respect to FIG. 5 and FIG. 6), a user threads a rope or cable about the pulley 736 (as shown) and attaches a first end of the rope or cable to a product 742 that the user would like to raise to a heightened position above to the ground. The user then pulls on the opposite (free) end of the rope or cable to raise the product 742 to a desired height above the ground and ties off the rope or cable (e.g., at a knot 744) to secure the product 742 at the desired height, as shown.

In different implementations, the ladder safety lock 704, the product lift 702, and the L-shaped lift support piece 724 may be made out of different materials. In one implementation, all three components are made out of metals, such as iron, galvanized steel, aluminum, etc., provided that the properties of the metals are sufficiently strong for weight-bearing.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A system comprising:

a ladder safety lock including:

a rod adapted for insertion through a first ladder rung;

at least one hinged flap attached an end of the rod, the at least one hinged flap configured for attachment to an anchor point on a free-standing structure; and a pulley system adapted to raise a load from ground level to a heightened position proximal to the first ladder rung, the pully system including a pulley:

a lift support piece adapted for insertion through a second ladder rung;

a product lift attached to the rod, the product lift including at least one elongated support beam that extends between the rod and the pulley; and a means for attaching a free end of the lift support piece to the product lift to prevent rotation of the product lift relative to the second ladder rung.

2. The system of claim 1, wherein the at least one hinged flap comprises two hinged flaps, each attached to an opposite end of the rod.

3. The system of claim 1, wherein the rod includes through-holes and the ladder safety lock further comprises a safety pin that inserts through a set of the through-holes to fixedly secure the rod within the first ladder rung.

4. The system of claim 1, wherein the lift support piece is L-shaped.

5. The system of claim 1, wherein the product lift includes a hollow cylindrical shaft on one end configured to couple with the rod of the ladder safety lock.

6. The system of claim 1, wherein the at least one elongated support beam of the product lift includes a first elongated support beam and a second elongated support beam with the pulley at a free end, the first elongated support beam coupled to form an angle with the second elongated support beam.

7. The system of claim 1, wherein the at least one hinged flap includes a first planar portion and a second planar portion separated from one another by a hinge, the first planar portion attached to the end of the rod and the second planar portion being adapted for attachment to the anchor point on the free-standing structure.

8. A method comprising:

inserting a rod of a ladder safety lock within a first ladder rung, the rod including at least one hinged flap being selectably attachable to an anchor point on a free-standing structure;

rotating the at least one hinged flap relative to the first ladder rung to place a portion of the at least one hinged flap in contact with the anchor point of the free-standing structure;

securely attaching the at least one hinged flap to the roof anchor point of the free-standing structures;

coupling a product lift to the rod of the ladder safety lock, the product lift including a pulley system with a pulley adapted to raise a load from ground level to a heightened position, the product lift including at least one elongated support beam that extends between the rod and the pulley;

inserting a first free end of a lift support piece into a second ladder rung; and securing the product lift to the lift support piece to prevent rotation of the product lift relative to the second ladder rung.

9. The method of claim 8, further comprising:

fixedly securing the rod within the first ladder rung.

10. The method of claim 8, wherein rotating the at least one hinged flap further comprises:

rotating a first hinged flap attached to a first end of the rod into contact with the anchor point of the free-standing structure;

rotating a second hinged flap attached to a second end of the rod into contact with the anchor point of the free-standing structure, and wherein securely attaching the at least one hinged flap further comprises securely attaching the first hinged flap and the second hinged flap to the anchor point of the free-standing structure.

11. The method of claim 8, wherein the at least one hinged flap includes a first planar portion and a second planar portion separated from one another by a hinge, the first planar portion being attached to an end of the rod and the second planar portion being adapted for attachment to the anchor point of the free-standing structure.

12. The method of claim 8, wherein fixedly securing the rod within the first ladder rung further comprises:

sliding a safety pin through a set of through-holes in the rod.

13. The method of claim 10, wherein fastening the product lift to the rod of the ladder safety lock further comprises inserting the rod through a hollow cylindrical shaft on one end of the product lift.

14. The method of claim 10, wherein the at least one elongated support beam of the product lift includes a first elongated support beam and a second elongated support beam, the second elongated support beam being coupled to the first elongated support beam and including the pulley at a first end.

15. The method of claim 14, wherein securing the product lift to the second elongated portion of the L-shaped lift support piece further comprises:

positioning the product lift with the pulley in a raised position relative to the first ladder rung;

while the pulley is in the raised position, rotating the second elongated portion of the L-shaped lift support piece toward a primary support beam of the product lift; and attaching the second elongated portion of the L-shaped lift support piece to the primary support beam of the product lift to secure the pulley at the raised position.

16. The method of claim 14, wherein the first ladder rung and the second ladder rung are consecutive, adjacent ladder rungs.

17. A system comprising:

a ladder safety lock including:

a rod adapted for insertion through a ladder rung;

at least one hinged flap attached an end of the rod, the at least one hinged flap including one or more through-holes to receive hardware for attaching the at least one hinged flap to an anchor point on a free-standing structure; and a pulley system adapted for attachment to the ladder safety lock, the pulley system including a pulley:

a lift support piece adapted for insertion through a second ladder rung;

a product lift operable to raise a load from ground level to a heightened position proximal to the ladder rung, the product lift is attached to the rod and including at least one elongated support beam that extends between the rod and the pulley, the lift support piece is attached to the product lift to prevent rotation of the product lift relative to the second ladder rung.

18. The system of claim 17, wherein the lift support piece is an L-shaped lift support piece with an elongated portion adapted to thread through and secure within the second ladder rung.

19. The system of claim 17, wherein the ladder safety lock further includes a locking mechanism for laterally securing the rod within the first ladder rung.

* * * * *